United States Patent [19]

Finley

[11] Patent Number: 4,929,155

[45] Date of Patent: May 29, 1990

[54] METHOD AND APPARATUS FOR CREATING A SECONDARY SOURCE OF POWER BY A PUMP

[75] Inventor: Richard O. Finley, Huntington Beach, Calif.

[73] Assignee: Plastiflex Company International, Fountain Valley, Calif.

[21] Appl. No.: 268,022

[22] Filed: Nov. 7, 1988

Related U.S. Application Data

[60] Division of Ser. No. 22,480, Mar. 5, 1987, Pat. No. 4,808,081, which is a continuation of Ser. No. 636,332, Jul. 31, 1984, abandoned.

[51] Int. Cl.[5] ..... F04B 47/12

[52] U.S. Cl. ..... 417/53; 4/490

[58] Field of Search ..... 417/53, 406–409; 4/490, 507, 509

[56] References Cited

U.S. PATENT DOCUMENTS

| | | | |
|---|---|---|---|
| 230,862 | 8/1880 | Cook | 417/406 |
| 3,121,528 | 2/1964 | Rhodes | 417/407 |
| 3,577,571 | 5/1971 | Bellinson | 4/490 |
| 3,759,290 | 9/1973 | D'Alba | 417/406 |
| 3,845,291 | 10/1974 | Portyrata | 362/192 |
| 4,347,979 | 9/1982 | Mathews | 4/490 |
| 4,555,221 | 11/1985 | DuBois | 417/349 |
| 4,583,500 | 4/1986 | Hundertmark | 417/404 |

*Primary Examiner*—Leonard E. Smith
*Assistant Examiner*—Robert N. Blackmon
*Attorney, Agent, or Firm*—Lewis B. Sternfels

[57] ABSTRACT

Apparatus (42, 72) is used to fill a hose (36) with water (12), from which a secondary source of power is derived, and simultaneously to expel air from the hose while connected to the vacuum side of a pump (20) without loss of the prime in the pump. The apparatus comprises a housing (44, 74) submergeable in the water and having a pair of chambers (46, 48 & 76, 78) respectively having inlets (58, 80) and outlets (64, 86), with the inlets being open to the water and the outlets being coupled respectively to the pump and to the hose. Impellers (54, 100 & 56, 102) respectively in their chambers are coupled together by a shaft (52, 98) in which a first of the impellers (54, 100) is driven by a second of the impellers (56, 102) when water is drawn by the pump past the second of the impellers. In one embodiment, when the hose is used as a suction conduct, an elbow conduit (110) can be slid from a first position where water purges air from the hose to a second position where the hose is used to clean debris from the swimming pool. In another embodiment, a hose end is first coupled to the pump's pressure side (24) to expel air from the hose and thereafter, without removing the hose end from the water, the hose end is coupled to the pump's vacuum side (22) when the hose is used to vacuum the pool.

20 Claims, 4 Drawing Sheets

METHOD AND APPARATUS FOR CREATING A SECONDARY SOURCE OF POWER BY A PUMP

This is a division of copending application, Ser. No. 22,480, filed 5 Mar. 1987, now U.S. Pat. No. 4,808,081, issued 28 Feb. 1989, in turn a continuation of Ser. No. 636,332, filed 31 July 1984, now abandoned.

FIELD OF THE INVENTION

The present invention relates to a method and apparatus for creating a secondary source of power in a hose by a pump to which the hose is attached.

DESCRIPTION OF THE PRIOR ART AND BACKGROUND CONSIDERATIONS

Pumps, when hoses are connected to the pump's vacuum side, create a negative pressure in the hoses for conveying liquids therethrough. Such pumps are subject to the serious problem of loss of prime when air or other gas is trapped within the hose and is drawn into the pump. While this problem exists in many areas of liquid transport, one major area of concern involves the cleaning of debris from swimming pools by suction hoses.

The most common current method for purging the hose of air is to place one end of the hose into the pool and to slip the hose slowly into the pool so that the water can move into and through the hose. If any air should inadvertently be left within the hose, when the hose is attached to the pool pump, and if the air reaches the pump, the pump will be deprimed. Therefore, extreme care and time must be taken to prevent entrapment of air within the hose.

Another method is where the operator's mouth is placed on an end of the hose so that water can be sucked into and through the hose. When the operator moves the hose from his mouth to the skimmer inlet, he must place his hand over the end of the hose to prevent entry of air into it.

In either case, filling of the hose with liquid to purge air therefrom is a lengthy and tiresome process. For a professional pool cleaner, this loss of time translates into a loss of income.

Because most swimming pools have a pool skimmer which is used to clean debris floating on the surface of the water by the pool pump, such a vacuum hose is conventionally coupled to the pump through the skimmer.

SUMMARY OF THE INVENTION

The present invention overcomes these and other problems by using the kinetic energy created by water flow to or from the existing pump to fill the hose with liquid and thereby to expel all the air therefrom.

Specific methods of accomplishing this are disclosed in the detailed description of the invention. Briefly, for pools under construction, a return line from the pressure side of the pump is attached to an orifice at the bottom of the skimmer. The orifice is terminated by a unidirectional valve which does not allow water to flow into the skimmer, but would permit the hose to be inserted into the valve and into communication with the pump's pressure side. This allows the hose to be filed with water, thereby expelling all air from the hose. The hose is then moved from the pressure orifice to the vacuum orifice adjacent thereto in the skimmer without removing the end of the hose from the water when the hose is to be used for suction purposes.

For pools which are already constructed, adding a return line to the skimmer would be very difficult and expensive. Therefore, the invention contemplates a specially designed construction to provide the same action by using the kinetic energy created by the water flow on the vacuum side of the pump. This construction has a driving impeller with a turbine vane coupled to a driving impeller. The water flow is used to turn the turbine vane to drive the driven impeller which acts as a pump to push water through the hose and thereby to expel all of the air therefrom. This construction is adapted for use in the existing skimmer inlet and is embodied in one of several designs, such as a part of the skimmer, a permanent attachment to the hose, or as a detachable attachment which is coupled to the hose for expulsion of air and removed from the hose after it has been filled with water when the hose is to be used as a suction device.

The method and apparatus of the present invention provides many advantages. Primarily, it is a fast and efficient method of filling a hose completely with a liquid by use of the pump, without causing loss of the prime in the pump. As a result, the homeowner or professional pool cleaner is relieved of much tedious and lengthy work, along with associated annoyance. Since time is conserved, the operator's time may be utilized for productive work or other activities. In the case of a professional pool cleaner, this savings of time permits a larger number of pools to be serviced, which translates into increased income or decreased loss of profit.

Other aims and advantages, as well as a more complete understanding of the present invention, will appear from the following explanation of exemplary embodiments and the accompanying drawings thereof.

DESCRIPTION OF THE PREFERRED EMBODIMENT

Figure 1:
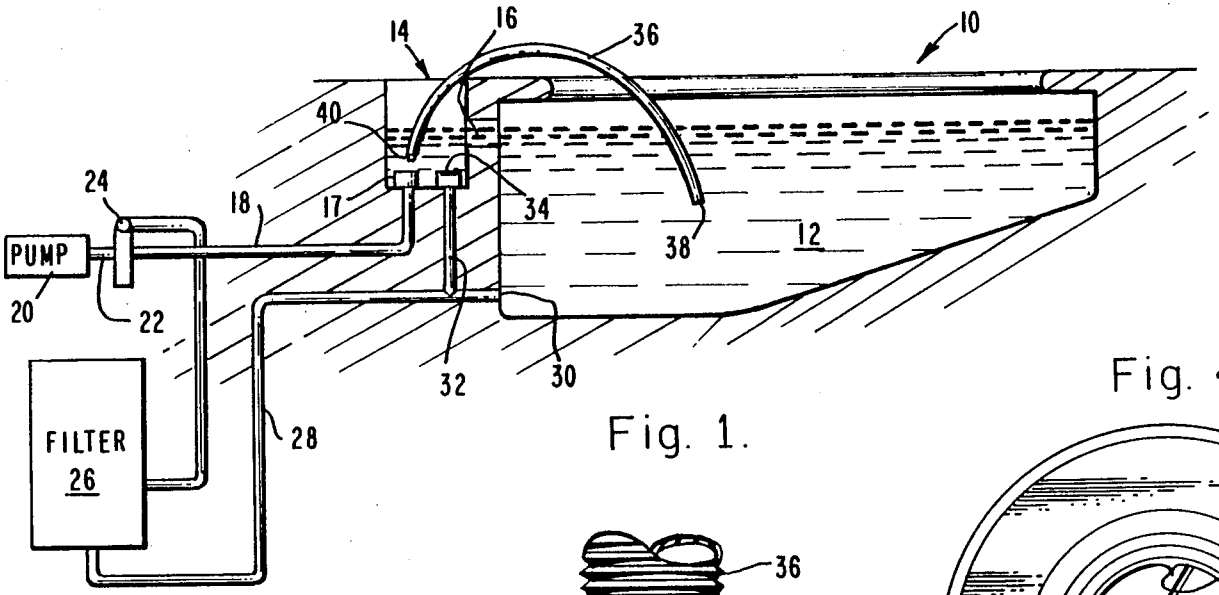
FIG. 1 illustrates a swimming pool with associated skimmer and pump, and an added conduit and unidirectional valve to provide a source of positive liquid pressure from the pressure side of the pump, which valve is adjacent the negative pressure inlet to the vacuum side of the pump, with the valve shown closed in FIG. 1 and opened by a hose cuff in FIG. 1*a*.

A conventional swimming pool arrangement for a swimming pool 10 filled with water 12 is shown in FIG. 1. The water in the pool communicates with an adjacent skimmer 14 of conventional construction through a channel 16, in which a floating weir is placed. The weir permits only surface water from the pool to be skimmed so that any floating debris thereon may be drawn into skimmer 14. Placed within the skimmer is a conventional strainer basket (not shown) and leading from an opening 17 in the skimmer is an intake conduit 18 which is coupled to a pump 20 at its vacuum or negative pressure side 22. Pump 20 discharges the water out of its pressure side 24, that is, a side which produces a positive pressure, through a filter 26, and back to the pool by a return conduit 28 at its outlet 30. At this point, the above-described arrangement is conventional.

The present invention adds a further conduit 32 which leads from return conduit 28 to skimmer 14. At its entry to the skimmer, conduit 32 is terminated by a unidirectional valve 34 of conventional construction. Valve 34 is designed to open towards return 28 and is prevented from opening into skimmer 14. It is normally biased into a closed position as shown in FIG. 1 by both a conventional spring and the positive water pressure within conduit 32.

For cleaning of debris from pool 10, a hose 36 is utilized. One end 38 of the hose or of a hose attachment is used to sweep the bottom of the pool while the other hose end 40 is disposed to be connected to intake 18 so that pump 20 will suck debris through end 38 and the hose. Usually a strainer is placed within the skimmer to prevent the debris from clogging the pump. Because the pump will lose its prime should any air in the hose be caught in the pump, it is necessary first to remove or purge any air from the hose.

Figure 1A:
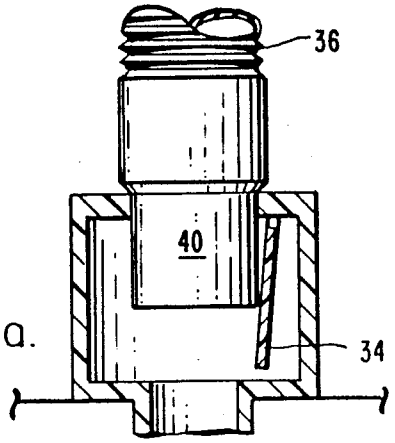

One purging method, which is accomplished in the present invention, is first to connect cuff 40 with conduit 32 through unidirectional flow valve 34 as illustrated in FIG. 1*a*. With the pump operating, a positive liquid pressure flows water through conduit 32 and thence through hose 36, to force or expel any air in the hose out through hose end 38. At such time as the air is purged or expelled from the hose and to use hose 36 as a suction device, cuff 40 is removed from conduit 32 which is closed upon closure of valve 34 by its spring and the pressure within conduit 32. Then, while keeping cuff 40 beneath the surface of the water, the cuff is inserted into opening 17 of conduit 18 which terminates at skimmer 14. Pump 20 thereupon draws water and any debris carried thereby from the pool through the hose.

Figure 4:
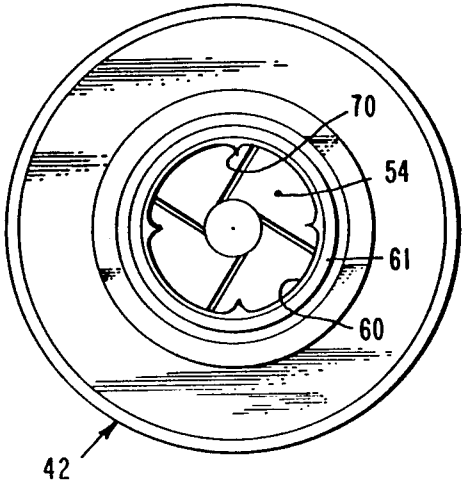
FIGS. 2–4 are views of a first embodiment of the present invention.
Figure 2:
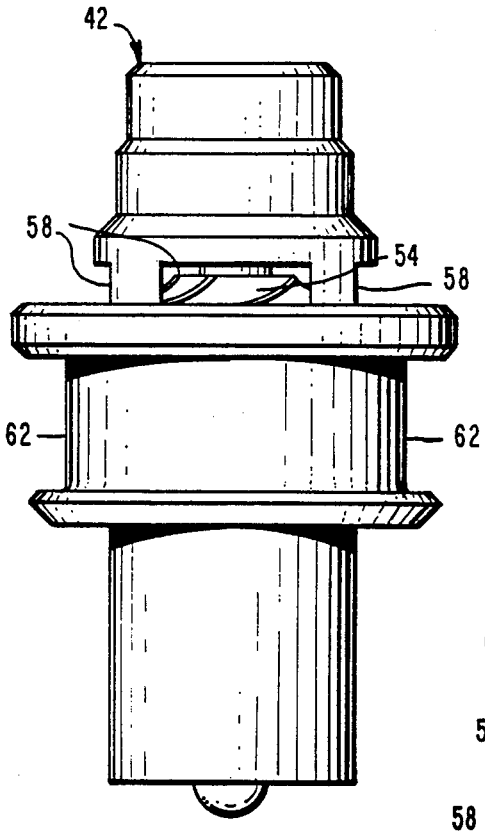
Figure 3:
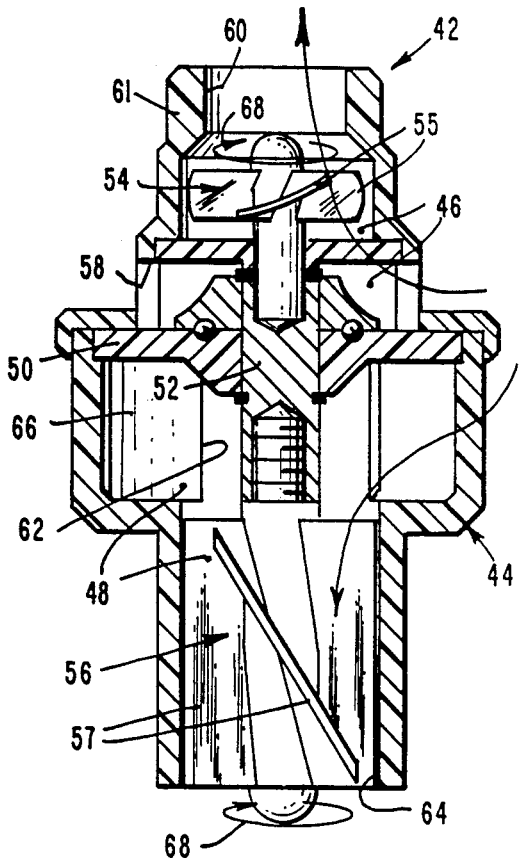

FIGS. 2–4 illustrate an apparatus 42 which may be used in lieu of conduit 32 for creating a positive pressure of water through hose 36. Apparatus 42 is disposed to be fully submerged in water. It comprises a housing 44 which is divided into a pair of chambers 46 and 48 by a plate 50, which acts also as a bearing mount for a shaft 52. Shaft 52 terminates in respective chambers 46 and 48.

An impeller 54 having vanes 55 is secured to one end of shaft 52 in first chamber 46, while a second impeller 56 having turbine vanes 57 is secured to the shaft within second chamber 48. First chamber 46 has one or more inlets 58 and an outlet 60. Inlet 58 is disposed to reside within water 12 within skimmer 14, while outlet 60 has a connection 61 to cuff 40 of hose 36.

Second chamber 48 is also provided with one or more inlets 62 and an outlet 64 so that water within skimmer 14 may flow into chamber 48 through inlets 62 and through outlet 64. A water flow channel 66 of a general spiral form enables water to move into chamber 48 in a circulatory movement in order to strike turbine vanes 57 of impeller 56 and thus to maximize the rotational forces exerted thereagainst.

Because of the flow of water through chamber 48, impeller 56 rotates and the driving force of impeller 56 is transmitted through shaft 54 to drive impeller 54. Rotation of impeller 54 pumps water through inlets 58 and through outlet 60 and thence through hose 36 to purge the hose of air. As shown, rotation of the impellers is in the direction of arrows 58. Because of the slant of vanes 57, the flow of water is through opposite outlets 60 and 64.

As best shown in FIG. 4, if it is desired to have the flow through outlet 60 move in a less swirling direction, projections 70 may be placed within outlet 60.

Figure 5:
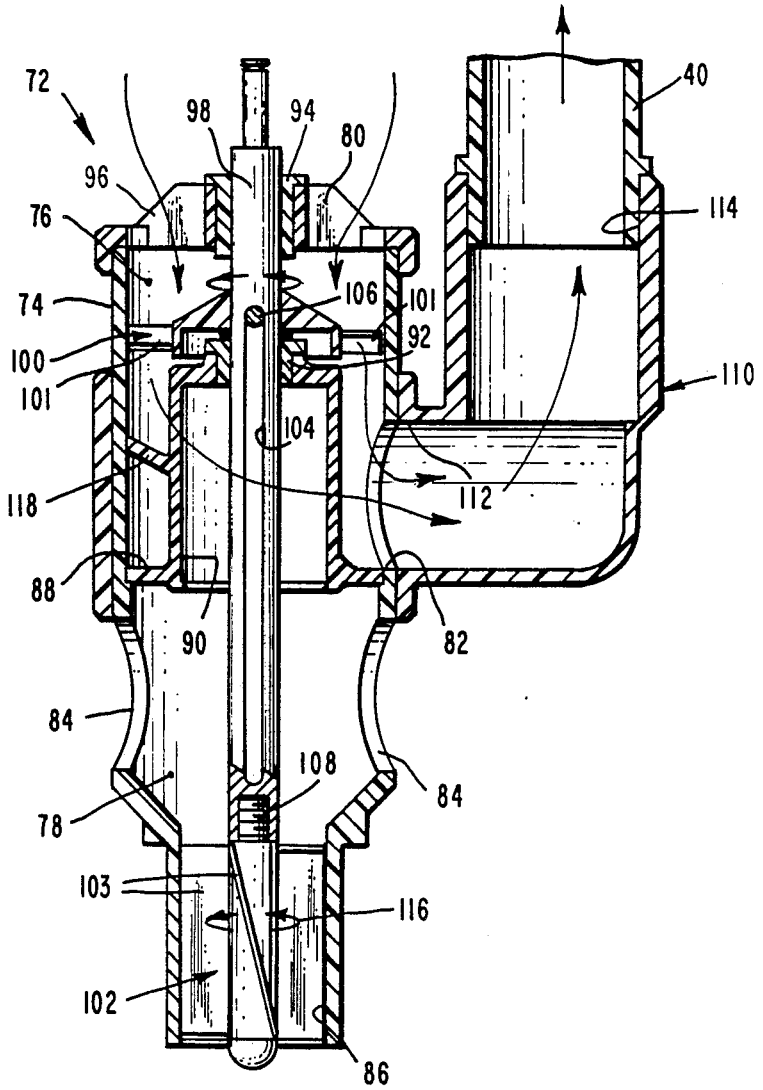
FIGS. 5 and 6 are views of a second embodiment respectively showing its air-purging position and its hose suction position after purging is accomplished.
Figure 6:
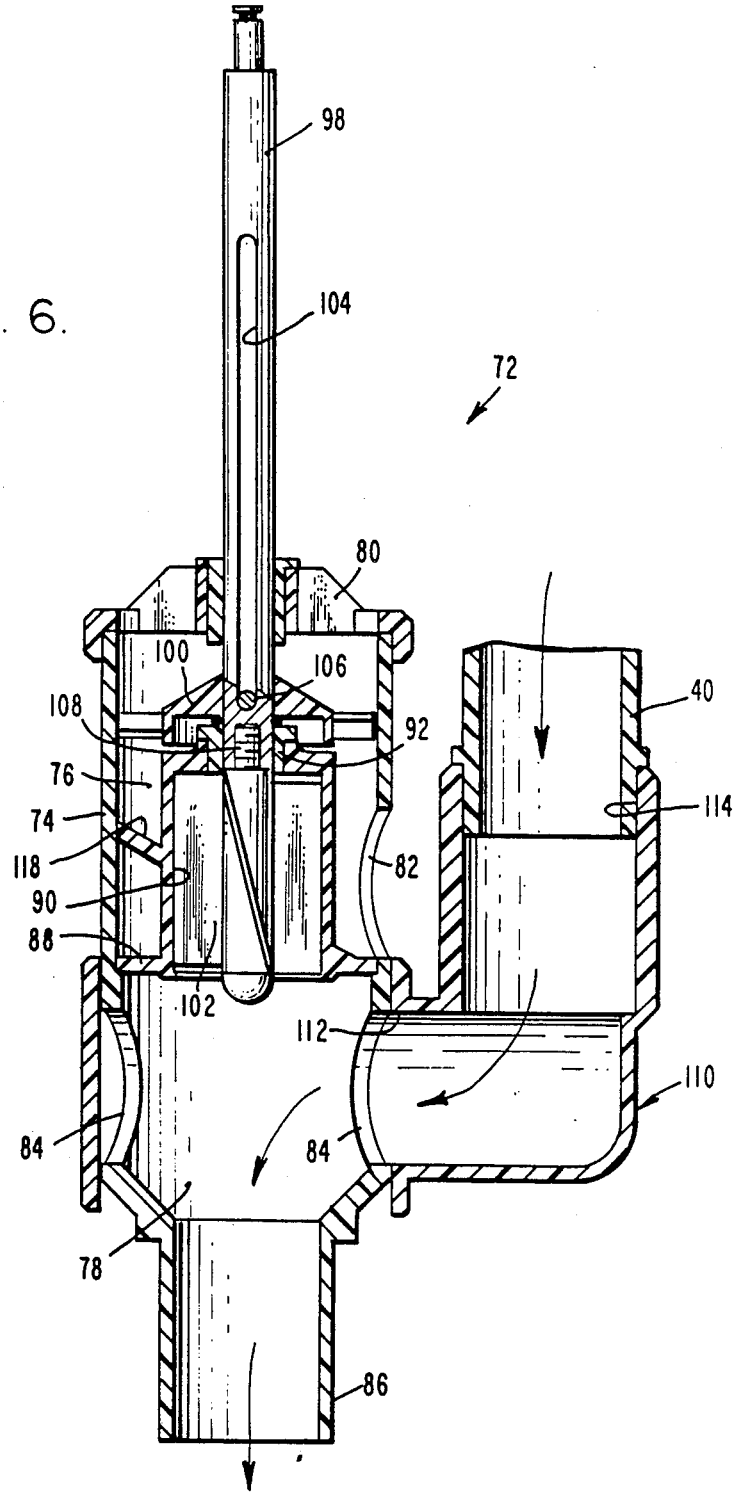

Referring now to FIGS. 5 and 6, a further embodiment is depicted as an apparatus 72 which also is to be fully submerged in the water. It includes a cylindrical housing 74 which is divided into first and second chambers 76 and 78. Liquid can enter first chamber 76 through an inlet 80 and can exit therefrom through an outlet 82. In a like manner, chamber 78 has liquid inlets 84 and an outlet 86.

The chambers are separated by a plate 88 which is provided with a recess 90 in communication with chamber 78 and which extends away from chamber 78 towards chamber 76. At the upper end of separator plate 88 and recess 90 is a bearing 92 which, along with bewaring 94 in a spoked bearing cap 96 at inlet 80 supports a rotatable shaft 98. The bearing cap is spoked to provide openings for inlet 80. An impeller 100 having vanes 101 is secured to shaft 98 within chamber 76 while a second impeller 102 having turbine vanes 103 is secured to the shaft within chamber 78. Impeller 100 is connected to shaft 98 so that it will rotate therewith. In addition, their connection also permits reciprocation with a slot 104 in shaft 98 through which a pin 106 extends. Pin 106 is affixed to impeller 100 so that shaft 98 may be linearly moved with respect to impeller 100. Impeller 102, on the other hand, is securely affixed to the shaft by a threaded connection at 108; thus, impeller 102 rotates with shaft 98 while the connection between impeller 100 and shaft 98 is rotatable and reciprocal.

Placed about the periphery of housing 74 is a slidable attachment 110 formed as an elbow conduit having a pair of openings 112 and 114. As shown in FIGS. 5 and 6, attachment 110 is slidable between first and second positions where its first position aligns its opening 112 with outlet 82 of chamber 76. In its second position, shown in FIG. 6, at such time for use of the hose as a suction conduit, attachment opening 112 is aligned with one of inlets 84 of chamber 78 while blocking off any others of inlets 84.

Cuff 40 of hose 38 is disposed to be coupled with opening 114 of attachment 110.

In operation, apparatus 72 is submerged in water 12 and is first inserted into termination or opening 17 of intake 18 at skimmer 14 by fitting outlet 86 within the intake termination. At this point, slidable attachment 110 is positioned as shown in FIG. 5 so that its opening 112 is aligned with outlet 82 of chamber 76. In addition, shaft 98 is slid fully within housing 74 so that impeller 102 is seated within outlet 86. Upon actuation of pump 20, water from skimmer 14 flows through inlets 84, through chamber 78, and into contact with turbine vanes 103 of impeller 102 to rotate the impeller in the direction of arrow 116. Such rotation causes shaft 98 and impeller 100 also to rotate. As impeller 100 rotates, it acts as a pump; that is, its vanes 101 cause fluid to flow through inlet 80, chamber 76 and out of outlet 82 for passage through slidable attachment 110 into cuff 40 and hose 38. A diverter 118 extending about the outer wall of recess 90 of separator plate 88 helps to smooth the flow of the water through chamber 76.

After all air has been purged or expelled from the hose and the hose is to be subjected to a negative pressure, slidable attachment 110 is slid downwardly so that, as shown in FIG. 6, its opening 112 is aligned with inlet 84 of chamber 78. Also, impeller 102 is moved out of outlet 86 by upward sliding of rod 98 so that impeller 102 resides within recess 90. Accordingly, water will flow from the hose into opening 114 of attachment 110 and thence through chamber 78 in outlet 86 into the pump, with a minimum of impediment to fluid flow.

Although the invention haws been described with reference to particular embodiments thereof, it should be realized that various changes and modifications may be made therein without departing the spirit and scope of the invention.

I claim:

1. In a swimming pool having a skimmer with a water inlet and a pump coupled to the inlet for enabling the pump to draw water from the skimmer and to return the water to the pool, a system for creating a secondary source of power, comprising:

first means adapted to be coupled to the inlet for enabling the pump to flow the water through the first means towards the pump and for deriving a primary source of power from the water flow; and second means coupled to said first means and the primary source of power for creating the secondary source of power.

2. A system according to claim 1 in which said first means includes a driving impeller and said second means includes a driven impeller respectively coupled to the inlet and to a conduit, and means for connecting said impellers together to cause said driving impeller to drive said driven impeller and to flow the water from the skimmer through the conduit.

3. A system according to claim 2 wherein said first and second means further include a housing having first and second chambers in which said driven and driving impellers are respectively journalled, said first chamber having means disposed to convey the water through said first chamber to the conduit and past said driven impeller upon rotation thereof, and said second chamber having means disposed to convey the water through said second chamber to the pump inlet and past said driving impeller for rotation thereof.

4. A system having a pump with negative and positive liquid pressure sides, an inlet at its negative pressure side and an outlet at its positive pressure side, for flow of a liquid to the pump and for creating a secondary source of power therefrom comprising:

first means including a driving impeller coupled to the pump for enabling the pump to flow the liquid towards the pump and for deriving a primary source of power from the liquid flow;

second means including a conduit coupled thereto for flow of the liquid through said conduit, and a driven impeller respectively coupled to the pump inlet and to the conduit, for creating the secondary source of power;

means for connecting said impellers together to cause said driving impeller to drive said driven impeller;

said first and second means further including a housing having first and second chambers in which said driven and driving impellers are respectively journalled, said first chamber having means disposed to convey the liquid through said first chamber to the conduit and past said driven impeller upon rotation thereof, and said second chamber having means disposed to convey the liquid through said second chamber to the pump inlet and past said driving impeller for rotation thereof, said first and second chamber means respectively having inlets and outlets for respective conveyance of the liquid; and a tubular attachment positioned about said housing and having a first opening coupled to the conduit and a second opening alignable for liquid flow communication with the outlet of said first chamber means.

5. A system according to claim 4 in which said means for connecting said impellers together comprises means for affixing said driving impeller to said shaft.

6. A system according to claim 5 further including a diverter in said first chamber for enhancing liquid flow therein from its inlet to its outlet.

7. A system according to claim 1 for filling a hose with the water, in which said first and second means comprise:

a housing submergeable in the skimmer and in the water and having a pair of chambers respectively having inlets and outlets, with said inlets open to the water and said outlets respectively coupled to the skimmer inlet and to the hose; and impellers connected together and respectively placed in said chambers for driving of a first of said impellers by a second thereof when water is drawn into the vacuum side of the pump through said chamber whose outlet is coupled thereto.

8. A system according to claim 7 further including a plate in said housing for separation thereof into said chambers, and a shaft extending through and journalled within said plate and having terminations in said chambers for connecting said impellers respectively to said shaft terminations.

9. A system according to claim 8 further including a conduit secured to said housing and having a first opening coupled to said hose and a second opening aligned with said outlet of said hose coupled chamber for enabling the water to be drawn by the pump through said pump coupled chamber and to drive said driving impeller and, in turn, said driven impeller for pumping the water through and into said hose coupled chamber and through the hose.

10. A system according to claim 7 further including a flow channel in said pump coupled chamber for enhancing movement of the water against turbine vanes on said impeller, and a flow channel in said hose coupled chamber for enhancing laminar flow of water therein.

11. A system according to claim 1 wherein said pump is unidirectionally operated to provide negative and positive liquid pressures respectively in its inlet and outlet and is coupled to a conduit for flow of liquid therethrough, in which said first and second means comprise:

means for effecting a coupling of the conduit and the pump inlet for enabling the pump to flow the liquid away from the pump in a forward direction through the conduit.

12. A system having a pump for flow of a liquid thereto and for creating a secondary source of power therefrom wherein the pump has vacuum and pressure sides, an inlet at its vacuum side and an outlet at its pressure side, and wherein the inlet and the outlet are coupled to a swimming pool, comprising:

first means coupled to the pump for enabling the pump to flow the liquid towards the pump and for deriving a primary source of power from the liquid flow;

second means coupled to said first means and the primary source of power for creating the secondary source of power; and a conduit adapted for being coupled to said second means for flow of the liquid through said conduit, said second means including a coupling for establishing a connection between the pressure outlet and the conduit.

13. A system according to claim 12 wherein the pool includes a skimmer and the inlet and the outlet have terminations in the skimmer, further including a normally closed unidirectional valve in the outlet termination which is operable by said coupling when said connection is established.

14. In a swimming pool system having a skimmer and a pump connected to an inlet of the skimmer, a method for flow of water from the skimmer inlet to the pump, and for creating a secondary source of power therefrom, comprising the steps of:

coupling first means to the skimmer inlet for enabling the pump to flow the water towards the pump and for deriving a primary source of power from the flow; and coupling second means to the first means and the primary source of power for creating the second source of power.

15. A method according to claim 14 wherein the pump creates a unidirectional source of negative and positive pressures and has an inlet for the negative pressure and an outlet for the positive pressure, in which said coupling steps comprise the steps of:

operating the pump for enabling flow of the water only from the pump and skimmer inlets to the outlet; and coupling both a conduit and the skimmer inlet to the source for creating a positive pressure of the water in the conduit by the pump to flow the water in a direction away from the pump.

16. A method according to claim 14 wherein the pump is arranged as a unidirectional source of negative and positive water pressures and has an inlet for the negative pressure and an outlet for the positive pressure, wherein said coupling steps comprise the steps of: p1 coupling a first impeller to the pump to draw some of the water into the pump;

coupling a second impeller to a conduit; and coupling the first and second impellers together on a common shaft so that the first impeller causes the second impeller to pump some of the water through the conduit in the forward direction;

said above three coupling steps thereby creating a positive pressure of the water in the conduit by the pump to flow the water in a direction away from the pump.

17. A method according to claim 14 for flowing the water through a conduit by the pump which is arranged as a unidirectional source of negative and positive water pressures and has an inlet for the negative pressure and an outlet for the positive pressure, wherein said coupling steps comprise the steps of:

coupling both the conduit and the inlet to the source for creating a positive pressure of the water in the conduit by the pump to flow the water in a direction away from the pump; and maintaining both the negative and positive pressures in the pump during said coupling step.

18. A method according to claim 17 wherein the conduit has one end coupleable to the pump and in which said coupling step for creating the positive water pressure in the conduit comprises the step of coupling the conduit to the pressure source outlet to enable the pressure source to force the water into the one conduit end.

19. A method according to claim 17 in which said coupling step for creating the positive water pressure in the conduit comprises the steps of impelling portions of the water into the pump and into the conduit, wherein said step of impelling the water into the pump enables said step of impelling the water into the conduit.

20. A method according to claim 17 in which said coupling step for creating the positive water pressure in the conduit comprises the steps of coupling a first impeller to the pump to draw some of the water into the pump, coupling a second impeller to the conduit, and coupling the first and second impellers together so that the first impeller causes the second impeller to pump some of the water through the conduit.

* * * * *